US005388774A

United States Patent [19]

Zizzo

[11] Patent Number: 5,388,774

[45] Date of Patent: Feb. 14, 1995

[54] CUTTER MEMBER FOR SCRAP REDUCTION MILL

[76] Inventor: Daniel M. Zizzo, c/o Michael Zizzo Scrap Steel Company, 6602 22nd Ave., Kenosha, Wis. 53140

[21] Appl. No.: 150,609

[22] Filed: Nov. 10, 1993

Related U.S. Application Data

[63] Continuation of Ser. No. 942,666, Sep. 9, 1992, abandoned.

[51] Int. Cl.[6] ..... B02C 13/18

[52] U.S. Cl. ..... 241/152.2; 241/191; 241/277; 241/294

[58] Field of Search ..... 241/152.2, 277, 191, 241/188.1, 294

[56] References Cited

U.S. PATENT DOCUMENTS

| | | | |
|---|---|---|---|
| 532,177 | 1/1895 | McLaughlin . | |
| 969,741 | 9/1910 | Archer . | |
| 2,360,086 | 10/1944 | Thurman et al. | 241/88.1 |
| 2,468,321 | 4/1949 | Bland | 241/191 |
| 3,283,698 | 11/1966 | Williams | 100/97 |
| 3,356,016 | 2/1967 | Eidal | 100/97 |
| 3,360,207 | 12/1967 | Shelton | 241/285 |
| 3,455,517 | 7/1969 | Gilbert | 241/189 |
| 3,489,078 | 1/1970 | Oberhellmann | 100/95 |
| 3,491,959 | 1/1970 | Jensen | 241/194 |
| 3,545,690 | 12/1970 | Burian et al. | 241/186 |
| 3,868,064 | 2/1975 | Coulter et al. | 241/186.4 |
| 3,995,782 | 12/1976 | Shallenberger et al. | 241/188 |
| 4,000,860 | 1/1977 | Gotham | 241/294 X |
| 4,134,555 | 1/1979 | Rosselet | 241/46 |
| 4,867,382 | 9/1989 | Manschwetus | 241/101 |

*Primary Examiner*—Frances Han

*Attorney, Agent, or Firm*—Walter J. Blenko, Jr.; Kirk D. Houser

[57] ABSTRACT

The application discloses a cutter member for use in a scrap reduction mill of the type which includes a rotating vertical shaft in a tapered shell. The cutter member is a unitary planar structure carrying cutter assemblies and having a central opening sized to fit and surround the shaft.

8 Claims, 3 Drawing Sheets

CUTTER MEMBER FOR SCRAP REDUCTION MILL

Figure 1:
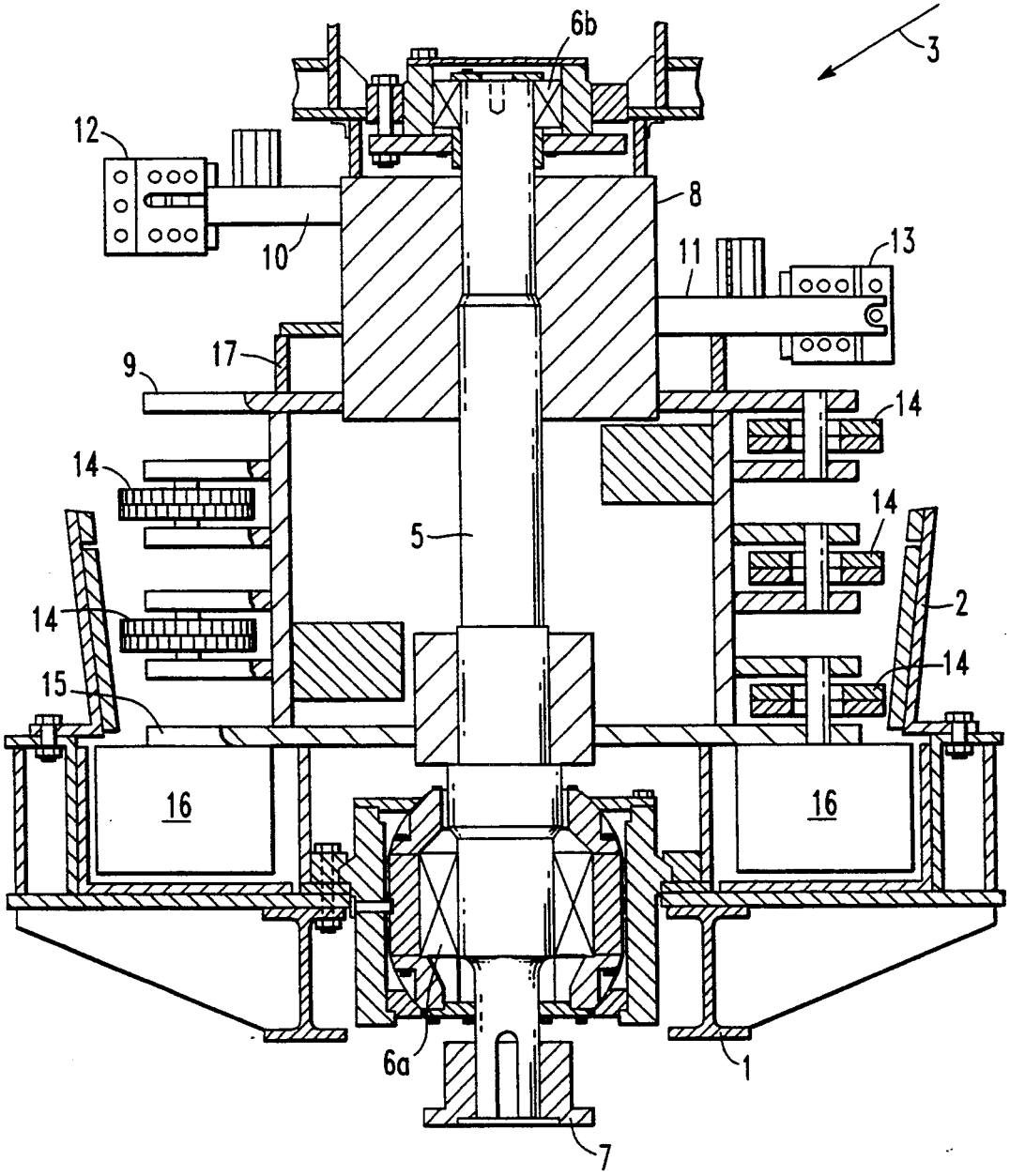

This is a continuation, of application Ser. No. 07/942,666, filed Sep. 9, 1992, now abandoned.

This invention relates to a cutter member for a scrap reduction mill intended to break up metal scrap and to agglomerate the material into compacted balls or pellets. More particularly, the invention relates to a cutter member intended to be mounted on a rotating vertical shaft within a conical shell which tapers inwardly and downwardly for reduction of scrap fed from the top.

A major commodity in the metals industry is scrap metal derived from products which no longer have economic utility and have been designated as "junk" or "scrap". A particularly prolific source of metal scrap is worn-out automobiles. A worn-out automobile has certain solid metal components such as an engine and an transmission and substantial non-metallic components such as rubber tires. The automobile contains some quantity of plastic and upholstery materials, and the balance is largely scrap metal enclosing a very large volume. In order to handle an automobile as scrapped without incurring an economic disadvantage, it is necessary to compact the automobile in some manner to make it into a dense agglomeration of metal without a substantial volume of enclosed air space.

A variety of proposals have been advanced for reducing metal scrap, such as automobiles, to a denser form economically and efficiently. A common practice has been to remove the rubber tires and engine and possibly the transmission. What remains is then passed through a mill with the objective of shredding and agglomerating the automobile body and its component parts into manageable pieces of scrap.

One comprehensive proposal for handling of scrap, such as automobile bodies, is shown in Coulter et al. U.S. Pat. No. 3,868,064 issued Feb. 28, 1975. The Coulter et al. apparatus comprises a conical shell or basket which tapers inwardly and downwardly. A rotatable shaft is vertically mounted in the center of the shell and carries a series of hammers and cutters which are intended to rotate with the shaft and to engage an automobile body or the like, pressing it outwardly against the shell. The rotary action of the shaft and associated cutters is intended to shred the metal and to roll it into balls or pellets of convenient size, e.g., four to six inches in diameter.

Automobile bodies are fed into the top of the conical shell by a feed conveyor. The Coulter et al. patent shows two arms mounted on the hub of a vertical shaft near the upper part of the shell. Each arm is welded to the hub and extends outwardly, terminating in a cutter which is intended to force the automobile body to the wall of the shell and to degrade it into pellet like masses. The two arms are positioned one above another and are angularly spaced 180 degrees on the shaft.

Certain operational difficulties have been found in attempting to reduce scrap in a mill of the type shown in the Coulter et al. patent. In practice, an automobile body does not nicely shred and agglomerate as might be thought from theoretical consideration. In some instances, additional metal such as a steel plate has been welded into the structure to increase its strength. Also, automobile bodies have been delivered to a scrap mill where through inadvertence or otherwise the engine has not been removed. Further, the frame may become wedged or aligned in such a way as to inhibit the contemplated shredding and to impose a severe overload on the machinery. Where such problems have arisen, a strong force is applied to the welded joint by which the arm is attached to the hub on the shaft. Instances have been known in which such an arm has broken free of the hub while rotating at high speed and has been thrown outwardly and through the wall of the building which houses the mill. Obviously, such an event poses considerable danger to the operator to any workman in the nearby area and even to others who may be outside the building.

Because the two arms are vertically spaced one from the other and because they rotate at high speed with the central shaft, rotation of the central shaft tends to set up an unbalanced rotating couple. In other words, the structure is dynamically out of balance.

I provide a cutter member for a scrap reduction mill having a revolving vertical shaft. I provide a cutter member which is horizontally planar and is unitary. I provide a central opening to receive and surround the vertical shaft. I further provide a circumference to the cutter member which is of varying radius and which has at least two portions of larger radius and which portions are evenly angularly spaced about the axis of the shaft. I prefer to form the cutter member from a single piece of steel, e.g., by machining. I further prefer to provide a circumference, a part of which is of constant radius and a part of which is of larger radius. I prefer that part of the circumference be tangential to a section of constant radius.

Other details, objects, and advantages of my invention will become more apparent as the following description of the present preferred embodiment thereof proceeds.

Figure 2:
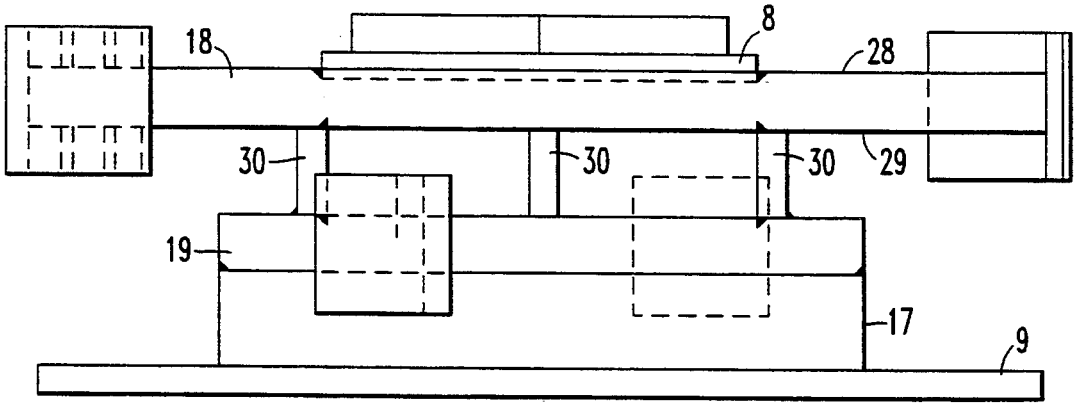
Figure 3:
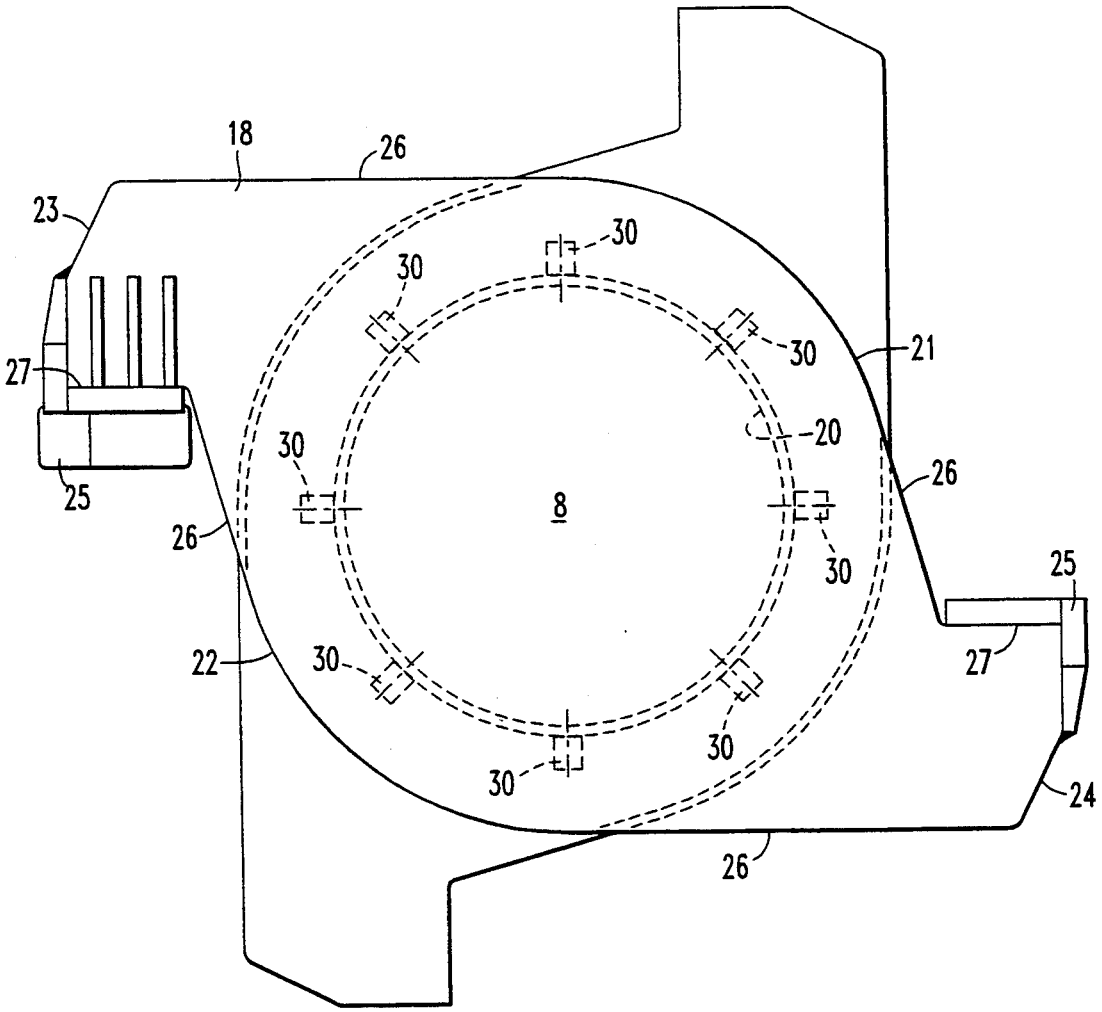

In the accompanying drawings, I have illustrated a present preferred embodiment of my invention in which FIG. 1 is a side sectional view of a conventional scrap reduction mill;

FIG. 2 is a side elevational view of a shaft for a rotary scrap reduction mill having two cutter members embodying my invention mounted thereon; and FIG. 3 is a plan view of the cutter members shown in FIG. 2.

A conventional scrap reduction mill is illustrated in sectional elevation, partially broken away, in FIG. 1. The mill includes a supporting base 1 which carries an inverted conical shell 2. Scrap metal pieces, such as automobile bodies, are delivered to the conical shell by a conveyor (not shown) which is generally along the axis 3. A central shaft 5 is rotatably journaled on a vertical axis in a lower bearing *6a* and an upper bearing *6b*. Shaft 5 and its attachments form a rotor. Shaft 5 is rotated by an electric motor (not shown) which is connected to a coupling 7.

A hub 8 is mounted on shaft 5. A plate 9 is mounted to the hub and extends outwardly toward shell 2 leaving clearance between the circumference of plate 9 and shell 2. An upper arm 10 and a lower arm 11 are welded to hub 8 and extend radially outwardly from hub 8. Arms 10 and 11 are diametrically opposed. Arms 10 and 11 carry cutter assemblies 12 and 13, respectively, mounted on their outer ends. Shell 2 extends upwardly to a point above the upper surface of cutter 12. Rotatable hammer units 14 are mounted to the rotor assembly below plate 9. A bottom plate 15 is mounted to the rotor assembly at the bottom of shell 2, leaving clearance between the circumference of plate 15 and shell 2, and carries blades 16 beneath.

A mill of the type shown in FIG. 1 is operated by energizing the drive motor causing the entire rotor assembly to rotate at a high speed. Scrap metal which is to be processed, e.g., automobile bodies, is fed into the top of the conical shell by the feed conveyor along line 3. Cutters 12 and 13 engage the automobile body which is also engaged by the inside wall of shell 2. Because cutters 12 and 13 are rotating and the shell is stationary, the effect is to shred scrap metal from the automobile body. The shredded pieces move downwardly between the shell and hammer assemblies 14 which fold and compact sheet metal into denser pellet- like masses. The agglomerated particles pass through the open space between bottom plate 15 and the bottom of shell 2, and they are swept from the mill by blades 16 which rotate with the rotor.

A major impact is taken by arms 10 and 11 when they first hit the scrap metal being fed into the mill. If the feed stock is used cars, and if heavy metal parts such as engines, transmissions, and axles are encountered, very substantial forces are imposed upon the arms and the structure. Experience has shown that there is a continuing problem because arms 10 and 11 which are welded to hub 8 tend to break from the hub at the joint. As a result, the arm which is traveling at a high rotating speed may be thrown tangentially from the hub with enough force to pass through the wall of the surrounding building. Such a result is dangerous and unacceptable. Even if the arm is not thrown from the mill, it must be rewelded to the hub causing downtime at the mill. Further in the process of rewelding, the arm tends to be shortened a small amount so that clearance between cutters 12 and 13 and shell 2 is increased. Thus, larger size pieces work downwardly and increase the load upon hammer assemblies 14.

FIGS. 2 and 3 show an improved form of cutter member embodying my invention and designed for use in a mill of the type shown in FIG. 1. Hub 8, plate 9, and boss 17 continue to be used and are identified by like numbers in FIGS. 2 and 3. An upper cutter member 18 and a lower cutter member 19 are provided. Upper cutter member 18 is a unitary structure preferably formed from a single piece of metal. It has a central circular opening 20 which fits upon and surrounds hub 8. The outer circumference of upper cutter arm 18 has two sections 21 and 22 which are of constant radius. Upper cutter member 18 also has two sections 23 and 24 of larger radius. Cutter assemblies 25 are mounted on the sections of larger radius. The circumference of upper cutter member 18 between the sections of constant radius 21 and 22 and the sections of larger radius 23 and 24 is tangential to sections 21 and 22 as indicated by reference numbers 26. A flattened recess or pocket 27 is provided on the end of each section of enlarged radius 23 and 24 to locate and position the associated cutter assembly 25. The upper surface 28 and lower surface 29 of cutter are parallel and are close together relative to the diameter of cutter member 18. Accordingly, upper cutter member 18 is a planar structure.

Cutter member 18 is fastened to rotor hub 8 by welding a bead circumferentially around central circular opening 20 at the intersection of hub 8 with upper surface 28 and lower surface 29 The opening 20 in cutter member 18 may be beveled to assist in obtaining a sound weld. Lower cutter member 19 is substantially identical to upper cutter member 18 and is fastened to hub 8 in the same manner. Spacer members 30 are interposed between cutter members 18 and 19 and may be attached to hub 8 and to the cutter members by welding. Cutter members 18 and 19 are fastened to hub 8 so that the cutter members are evenly angularly disposed about the circumference of the rotor. Optionally, the apparatus may be operated with a single upper rotor which contacts and shreds scrap coming into shell 2 and passes shredded scrap downwardly to hammer assemblies 14. That modification will reduce the number of primary cutting sweeps for each revolution of the rotor and will reduce the capacity of the mill.

When a mill is operated embodying cutters 18 alone or 18 and 19 together, the mass and unitary nature of the cutter members causes impact shocks to be distributed throughout the cutter members. If an unexpectedly severe impact is encountered, the effect will be to shear the welding beads which attach the cutter members to the hub. Accordingly, the hub will continue to rotate independently of the cutter members until power can be shut off and the mill can be brought to a stop. There will not be a structural failure which could cause any parts to be thrown through the air from the mill. Instead, there will be a controlled failure which can readily be repaired. Rewelding of the cutter members to the hub will not cause any displacement of cutter assemblies 25 so that the clearances will continue without change and as designed. The weld zone is substantially greater than in the case of an arm welded to the hub. Accordingly, a failure is less likely with the cutter member. Because each cutter member is planar, the cutter is dynamically balanced for rotation and will not generate a rotating unbalanced coupling which would place pounding forces on bearings 5 and 6. The dynamic balance further leads to smooth running of the mill without destructive vibration of the entire frame.

While I have illustrated and described certain present and preferred embodiments of my invention, it is to be understood that I do not limit myself thereto, and that my invention may be otherwise variously practiced within the scope of the following claims.

I claim:

1. In a scrap reduction mill having a rotating vertical shaft supporting hammer assemblies and positioned within a conical shell which tapers inwardly and downwardly, the improvement which comprises a unitary, horizontally planar cutter member positioned above said hammer assemblies and having a central opening into which the vertical shaft extends, the cutter member being of varying radius around the cutter member's circumference, and having at least two portions of the circumference which are of a radius greater than the radii of adjacent parts of the circumference, the portions of greater radius being evenly, angularly spaced around the circumference.

2. The scrap reduction mill of claim 1 in which part of the circumference of the cutter member is of constant radius.

3. The scrap reduction mill of claim 2 in which part of the circumference of the cutter member is tangential to a section of constant radius.

4. The scrap reduction mill of claim 1 in which the cutter member is formed from a single piece of metal.

5. An apparatus for a scrap reduction mill of the type having a revolving vertical shaft, said apparatus comprising a unitary cutter member being horizontally planar and having a central opening into which the revolving vertical shaft extends, the cutter member being of varying radius around the cutter member's circumference, and having at least two portions of the circumference which are of a radius greater than the radii of adjacent parts of the circumference, the portions of greater radius being evenly, angularly spaced around the circumference.

6. The cutter member of claim 5 in which part of the circumference of the cutter member is of constant radius.

7. The cutter member of claim 6 in which part of the circumference of the cutter member is tangential to a section of constant radius.

8. The cutter member of claim 5 which is formed from a single piece of metal.

* * * * *